US007577381B2

(12) United States Patent
Takuwa

(10) Patent No.: US 7,577,381 B2
(45) Date of Patent: Aug. 18, 2009

(54) TRANSFER BELT UNIT AND METHOD OF SUPPORTING HANDLE OF THE SAME

(75) Inventor: Noriyuki Takuwa, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 160 days.

(21) Appl. No.: 11/743,237

(22) Filed: May 2, 2007

(65) Prior Publication Data

US 2007/0286651 A1 Dec. 13, 2007

(30) Foreign Application Priority Data

May 15, 2006 (JP) ..... 2006-135098

(51) Int. Cl.
*G03G 15/14* (2006.01)
*G03G 15/00* (2006.01)

(52) U.S. Cl. ..... 399/121; 399/308

(58) Field of Classification Search ..... 399/107, 399/110, 121, 302, 303, 309, 313
See application file for complete search history.

(56) References Cited

U.S. PATENT DOCUMENTS 6,999,709 B2 * 2/2006 Park ..... 399/302
7,162,192 B2 * 1/2007 Yamada et al. ..... 399/302
7,392,001 B2 * 6/2008 Okazaki ..... 399/299
2002/0021916 A1 * 2/2002 Wakana ..... 399/121
2005/0074259 A1 * 4/2005 Tachiki et al. ..... 399/121
2006/0045579 A1 * 3/2006 Ozawa et al. ..... 399/302
2007/0231001 A1 * 10/2007 Kaiho et al. ..... 399/121

FOREIGN PATENT DOCUMENTS

JP 2000-194203 7/2000
JP 2000-231271 8/2000
JP 2004-138945 5/2004

* cited by examiner

*Primary Examiner*—David M Gray
*Assistant Examiner*—Gregory H Curran
(74) *Attorney, Agent, or Firm*—Turocy & Watson, LLP

(57) ABSTRACT

There is provided a technology capable of avoiding troubles caused by accidentally holding a handle for holding a transfer belt unit in maintaining the transfer belt unit.

The transfer belt unit contains a frame unit that is composed of a plurality of frame members and supports rollers around which a transfer belt is wound, a connecting unit that connects the plurality of frame members of the frame unit to one another relatively rotatably on a plane including the rotational direction of the transfer belt, a fixing unit that is movable between a fixing position where the plurality of frame members is fixed to one another, and a handle unit that is supported at one end thereof on any one of the frame members and supported at the other end thereof by the fixing unit only when the fixing unit is located on the fixing position.

14 Claims, 8 Drawing Sheets

TRANSFER BELT UNIT AND METHOD OF SUPPORTING HANDLE OF THE SAME

BACKGROUND OF THE INVENTION

1. Field of the Invention

The present invention relates to a transfer belt unit used in an image forming apparatus, and particularly, to a structure for mounting a handle for holding the transfer belt unit.

2. Description of the Related Art

FIG. 10 is a view illustrating a conventional transfer belt unit 200. In the transfer belt unit 200, transfer rollers RY, RM, RC and RK for transferring each of the colors Y, M, C and K are arranged in a transfer belt 90 tensioned around a driving roller and driven roller (not shown). These transfer rollers RY, RM, RC and RK are brought into or out of contact with the inner surface of the transfer belt 90 according to the moving positions of a left front link lever 79 and a right front link lever 89 of a link mechanism for switching modes. The switching of modes is realized by these contact and separation (see, for example, Jpn. Pat. Appln. Laid-Open Publication No. 2006-042768).

However, in the above conventional transfer belt unit, the mounting and dismounting of the transfer belt are not so easy. Thus, to facilitate maintenance, there is proposed a technology of bending or folding the transfer belt unit in the image forming apparatus (see, for example, Jpn. Pat. Appln. Laid-Open Publication No. 2004-109267).

In the conventional transfer belt unit as described above, in the case where a handle for holding the transfer belt unit is provided, if attempted to lift up the transfer belt unit bent for maintenance by holding the handle, the bent transfer belt may be extended despite the intension, resulting in damage or failure of the transfer belt unit.

SUMMARY OF THE INVENTION

The present invention has been made to solve the above problem and an object thereof is to provide a technology capable of avoiding troubles caused by holding the handle for holding the transfer belt unit by accident in maintaining the transfer belt unit.

To solve the above problem, according to one embodiment of the present invention, there is provided a transfer belt unit including: a frame unit that is composed of a plurality of frame members and supports rollers around which a transfer belt is wound; a connecting unit that connects the plurality of frame members of the frame unit to one another relatively rotatably on a plane including the rotational direction of the transfer belt; a fixing unit that is movable between a fixing position where the plurality of frame members being fixed to one another so that a predetermined positional relationship may be established in rotating the transfer belt and release position where the fixing of the plurality of frame members to one another is released; and a handle unit that is supported at one end thereof on the side of the frame members and supported at the other end thereof by the fixing unit only when the fixing unit is located on the fixing position.

Moreover, according to one embodiment of the present invention, there is provided a transfer belt unit including: a roller supporting means composed of a plurality of frame members for supporting rollers around which a transfer belt is wound; a connecting means for connecting the plurality of frame members of the roller supporting means to one another relatively rotatably on a plane including the rotational direction of the transfer belt; a fixing means movable between a fixing position where the plurality of frame members is fixed to one another so that a predetermined positional relationship may be established in rotating the transfer belt and release position where the fixing of the plurality of frame members to one another is released; and a holding means capable of being held by being supported at one end thereof on any one of the plurality of frame members and supported at the other end thereof by the fixing means only when the fixing means is located on the fixing position.

Further, a method of supporting a handle according to one embodiment of the present invention is a method of supporting a handle for holding a transfer belt unit including: a frame unit that is composed of a plurality of frame members and supports rollers around which a transfer belt is wound; a connecting unit that connects the plurality of frame members of the frame unit to one another relatively rotatably on a plane including the rotational direction of the transfer belt; a fixing unit that is movable between a fixing position the plurality of frame members is fixed to one another so that a predetermined positional relationship may be established in rotating the transfer belt and release position, where the fixing of the plurality of frame members to one another is released. Any one of the plurality of frame members supports one end of the handle, and the fixing unit supports the other end of the handle only when the fixing unit is in the fixing position.

DETAILED DESCRIPTION OF THE PREFERRED EMBODIMENTS

Figure 1:
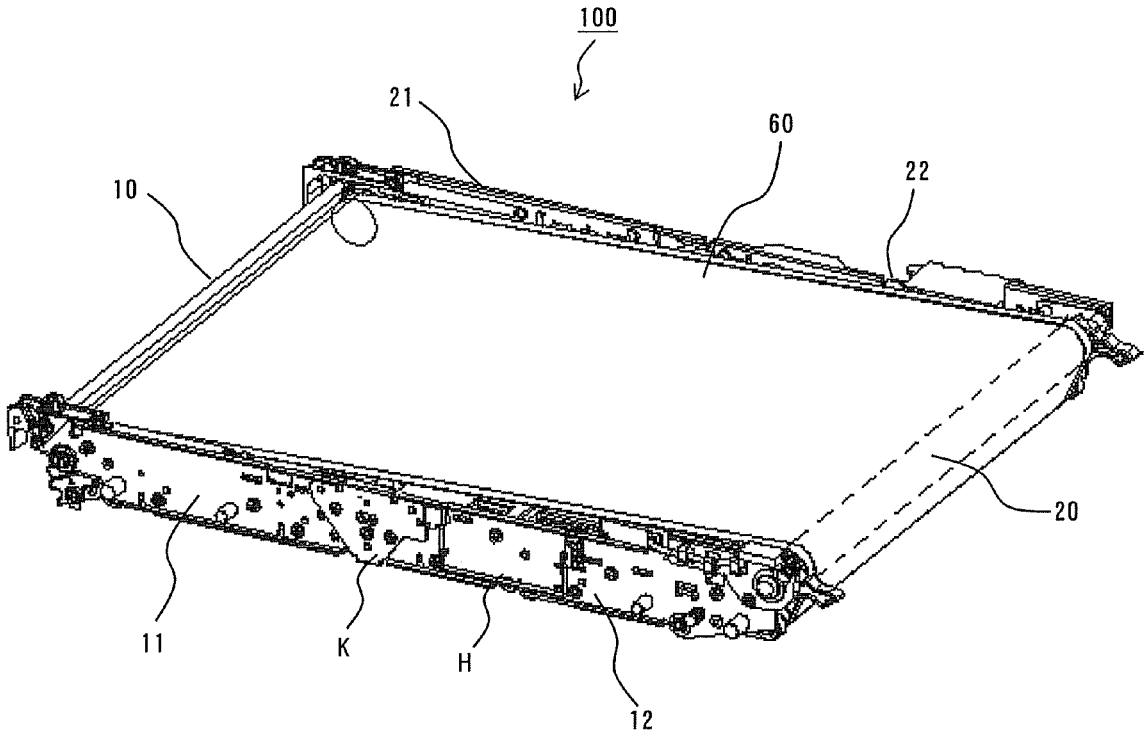
FIG. 1 is a perspective view showing an embodiment of a transfer belt unit according to the present invention.
Figure 2:
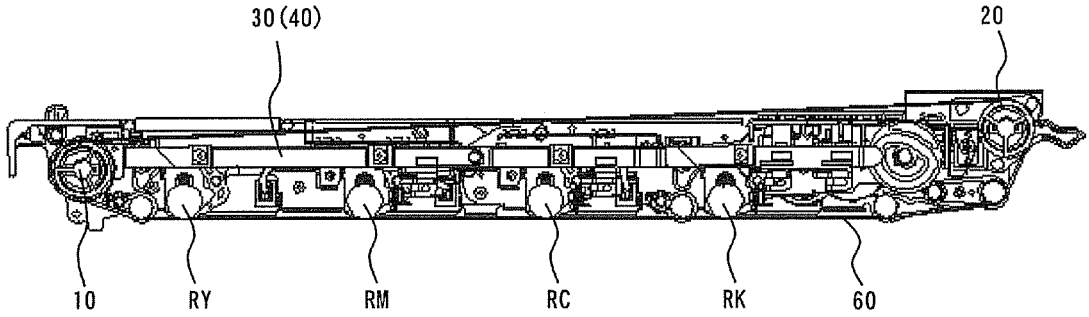
FIG. 2 is a sectional view simply illustrating a state of the transfer belt unit of FIG. 1 in full-color printing mode.
Figure 3:
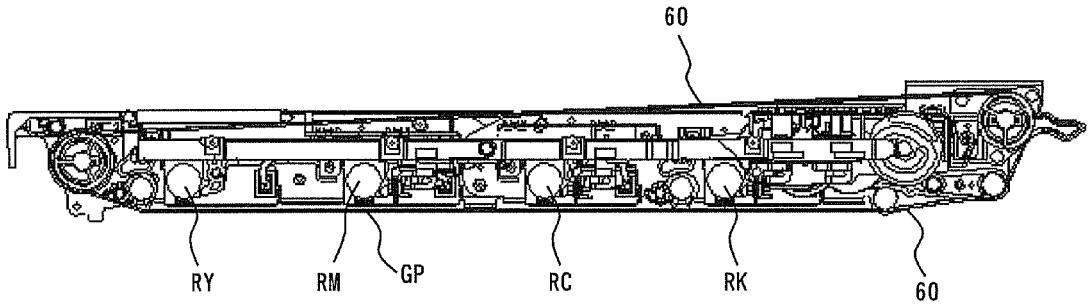
FIG. 3 is a sectional view simply illustrating a state of the transfer belt unit of FIG. 1 in resting mode.
Figure 4:
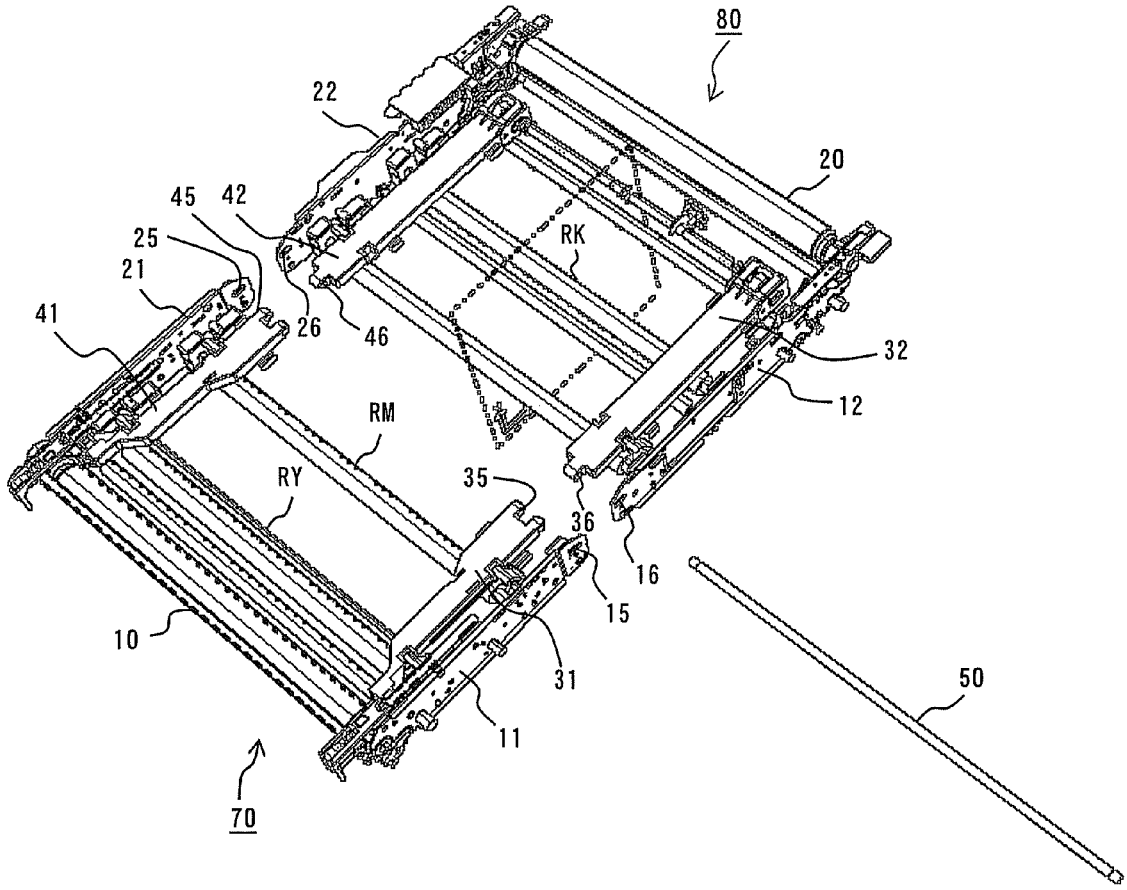
FIG. 4 is a development view illustrating an assembling structure of the inner members of the transfer belt unit shown in FIGS. 1 to 3.
Figure 5:
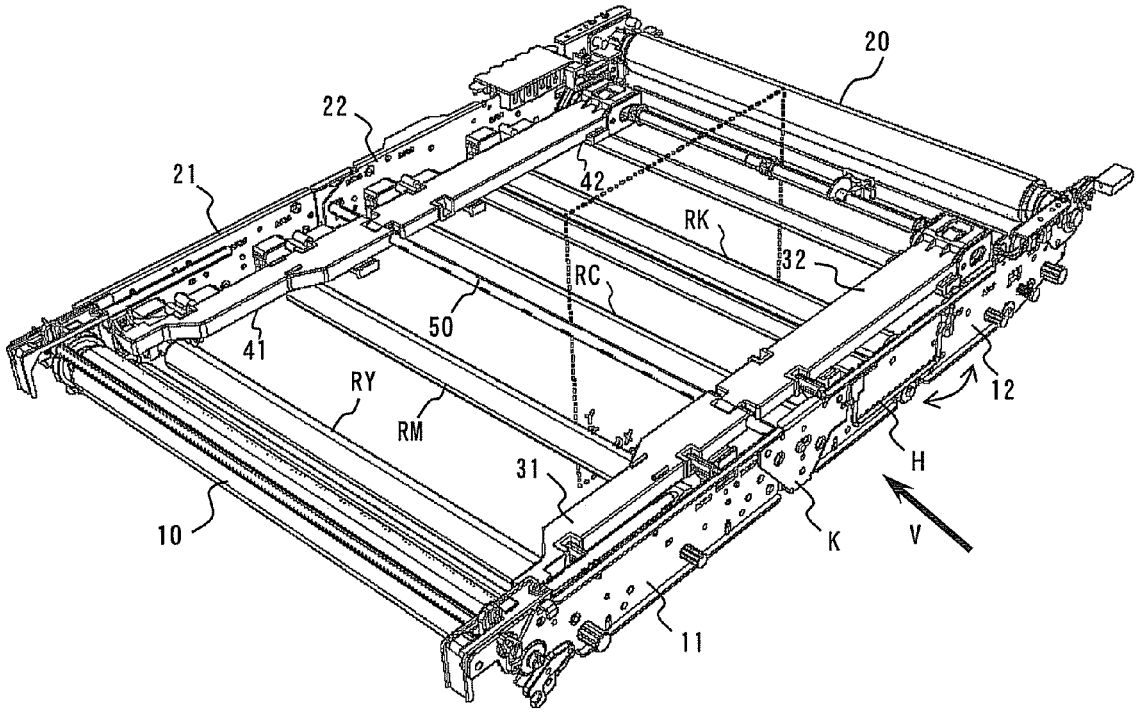
FIG. 5 is a view showing a state in which the respective units shown in FIG. 4 are assembled.

Now, an embodiment of the present invention will be described with reference to the accompanying drawings. FIG. 1 is a perspective view showing an embodiment of a transfer belt unit of the present invention. FIG. 2 is a sectional view simply illustrating a state of the transfer belt unit of FIG. 1 in full-color printing mode. FIG. 3 is a sectional view simply illustrating a state of the transfer belt unit of FIG. 1 in resting mode. FIG. 4 is a development view illustrating an assembling structure of the inner members of the transfer belt unit shown in FIGS. 1 to 3. FIG. 5 is a view showing a state in which the respective units shown in FIG. 4 are assembled. The transfer belt unit according to the present embodiment has a function of performing mode switching at least between full-color printing mode and black-and-white printing mode by a link mechanism.

As shown in FIG. 1, the transfer belt unit 100 is substantially rectangular solid shape and has a driven roller 10 arranged at least at one end and a driving roller 20 arranged on the other opposing end. A transfer belt 60 is tensioned between the driving roller 20 and driven roller 10. The transfer belt 60 tensioned between the driving roller 20 and driven roller 10 is configured to be able to endlessly rotate between a left side surface including a left front side surface 11 and left rear side surface 12 and right side surface including a right front side surface 21 and right rear side surface 22.

In the transfer belt unit, a link lever 30 comprising a left front link lever 31 and left rear link lever 32 is arranged near the left side surface thereof. Moreover, a link lever 40 comprising a right front link lever 41 and right rear link lever 42 is arranged near the right side surface thereof. Moreover, transfer rollers RY, RM, RC and RK are arranged parallel to the driven roller 10 and driving roller with being pinched between the left and right side surfaces. These transfer rollers RY, RM, RC and RK are responsible for transferring the colors of Y, M, C and K respectively.

When the link levers 30 and 40 operating the link mechanism for performing mode switching is moved to the side of the driven roller 10, as shown in FIG. 2, the transfer rollers RY, RM, RC and RK move downward and come into contact with the inner surface of the transfer belt 60, thereby enabling transfer. That is, in this case, the operating state is in full-color printing mode. When the link levers 30 and 40 are moved to the side of the driving roller 20, as shown in FIG. 3, the transfer rollers RY, RM, RC and RK move upward and come out of contact with the inner surface of the transfer belt 60, thereby disabling transfer. That is, the operating state is in resting mode. In black-and-white printing mode, though not shown in the drawings, only the transfer roller RK comes into contact with the inner surface of the transfer belt 60.

The main members of the transfer belt unit 100 include, as shown FIG. 4, a front unit 70 and rear unit 80 formed by dividing a conventional transfer belt unit into two at the center thereof, a connecting shaft (shaft member) 50 that connects the both units 70 and 80 to each other, and a transfer belt 60. That is, in the front unit 70, there are arranged a driven roller 10, left front side surface 11, right front side surface 21, left front link lever 31, right front link lever 41, and transfer rollers RY and RM. Moreover, in the rear unit 80, there are arranged a driving roller 20, left rear side surface 12, right rear side surface 22, left rear link lever 32, right rear link lever 42, and transfer rollers RC and RK. Here, the left front link lever 31, right front link lever 41, left rear link lever 32 and right rear link lever 42 correspond to a plurality of link members and configure a link unit (mode switching means). Moreover, the left front side surface 11, right front side surface 21, left rear side surface 12 and right rear side surface 22 correspond to a plurality of frame members and configure a frame unit (roller supporting means).

The link unit is composed of a plurality of link members connected to one another by a shaft member and has a role of performing mode switching by the plurality of cooperating link members. Moreover, the frame unit is composed of a plurality of frame members and has a role of supporting the driven roller 10 and driving roller 20 around which the transfer belt is wound in the transfer belt unit. Moreover, the link unit is composed of two link members connected to each other by a shaft member at a substantially central position in the longitudinal direction of the transfer belt unit.

At the respective divided ends of the left front side surface 11, right front side surface 21, left rear side surface 12 and right rear side surface 22, there are pierced long holes 15, 25, 16 and 26 in directions in which the link levers extend. These long holes have a role of allowing for the movement of the shaft members accompanying the movement of the link unit in performing the mode switching in the transfer belt unit. Moreover, at the respective divided ends of the link levers 31, 41, 32 and 42, there are pierced round holes 35, 45, 36 and 46. In assembling, the long holes 15 and 16 as well as the long holes 25 and 26 are superimposed on each other, and the round holes 35 and 36 as well as the round holes 45 and 46 are superimposed on each other. A connecting shaft is inserted so as to pass through these long holes and round holes thereby to be mounted.

In this manner, according to the above configuration, the plurality of frame members of the frame unit are connected to one another relatively rotatably with the shaft member connecting the plurality of link members to one another as a central axis on a plane including the rotational direction of the transfer belt. Here, the vicinity of the unit in which the long holes in the left front side surface 11, right front side surface 21, left rear side surface 12 and right rear side surface 22 are formed corresponds to the connecting unit (connecting means).

Figure 6:
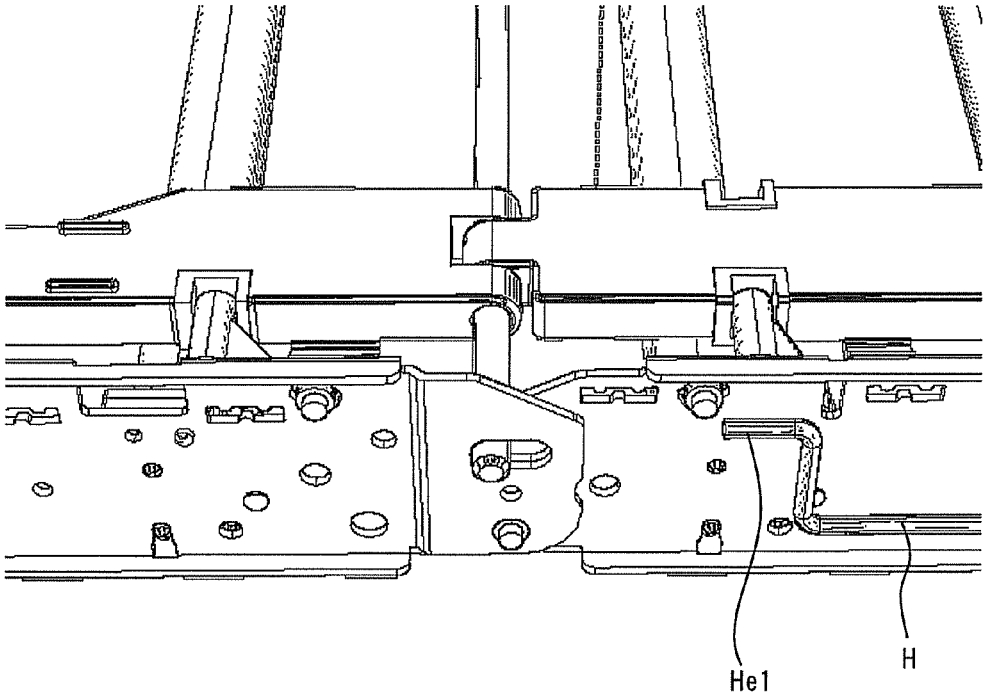
FIG. 6 is a view showing a relationship between a connecting shaft and a long hole on the side surface when a link lever of the embodiment has been moved to a driven roller side.
Figure 7:
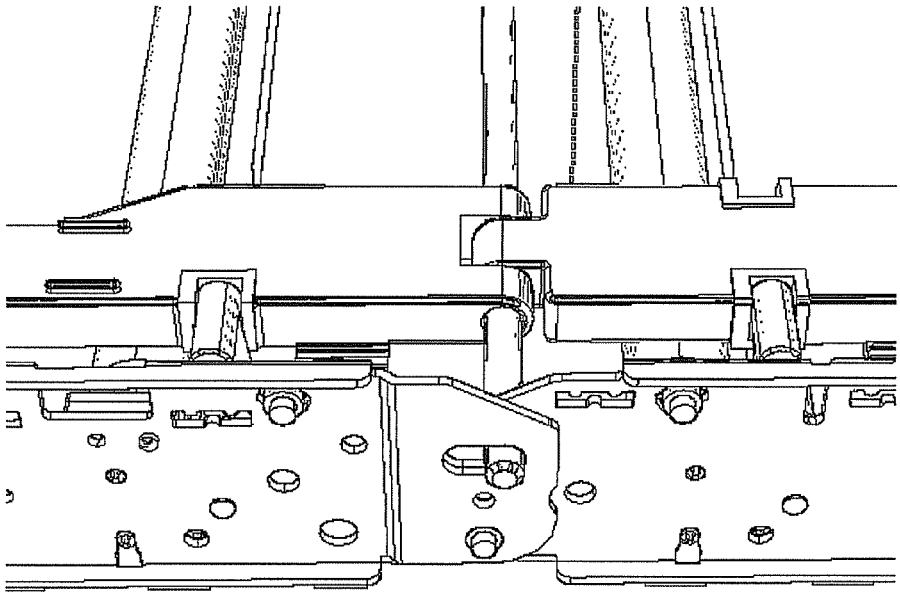
FIG. 7 is a view showing a relationship between the connecting shaft and the long hole on the side surface when the link lever of the embodiment has been moved to a driving roller side.
Figure 8:
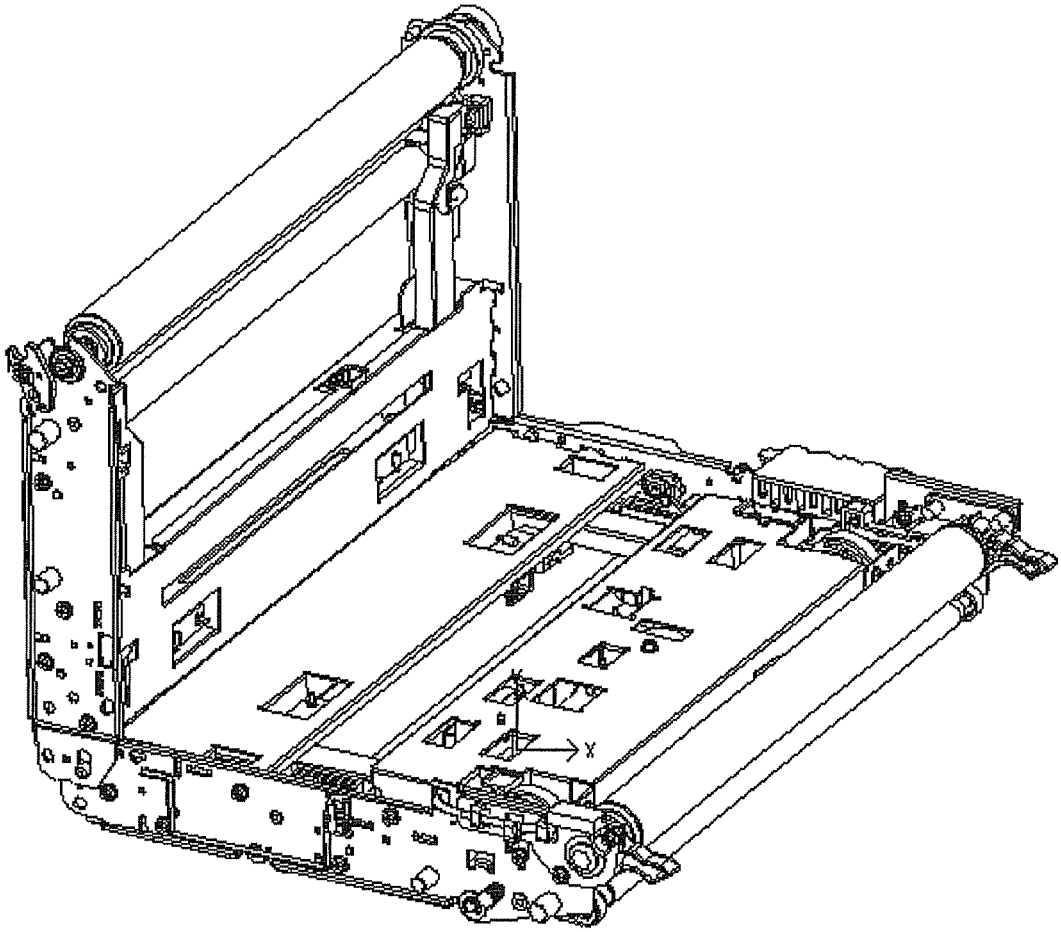
FIG. 8 is a view showing a state in which the respective units assembled as shown in FIG. 5 are folded by about 90 degrees.

A completion view in which the front unit 70 and rear unit 80 shown in FIG. 4 are assembled by the connecting shaft 50 is shown in FIG. 5. Here, when the link levers 31 and 32 as well as the link levers 41 and 42 are moved to the side of the driven roller 10, the operating state is as shown in FIG. 6. When the link levers 31 and 32 as well as the link levers 41 and 42 are moved to the side of the driving roller 20, the operating state is as shown in FIG. 7. Moreover, in this example, the front unit 70 and rear unit 80 can be bent or folded, as shown in FIG. 8, by about 90 degrees (predetermined angle) with the connecting shaft 50 as a central axis. Moreover, by performing bending with the shaft connecting the link mechanism as a central rotational axis, the transfer belt unit can be bent without applying excessive load to the link mechanism.

In the above case, since the long holes 15, 16, 25 and 26 are provided on the side surfaces, the link levers 31, 32, 41 and 42 can be bent or folded freely at any positions. If the transfer belt unit 100 in which the link mechanism is arranged can be bent or folded as shown in FIG. 8, the mounting/dismounting of the transfer belt 60 in/from the transfer belt unit 100 can be facilitated.

Figure 9:
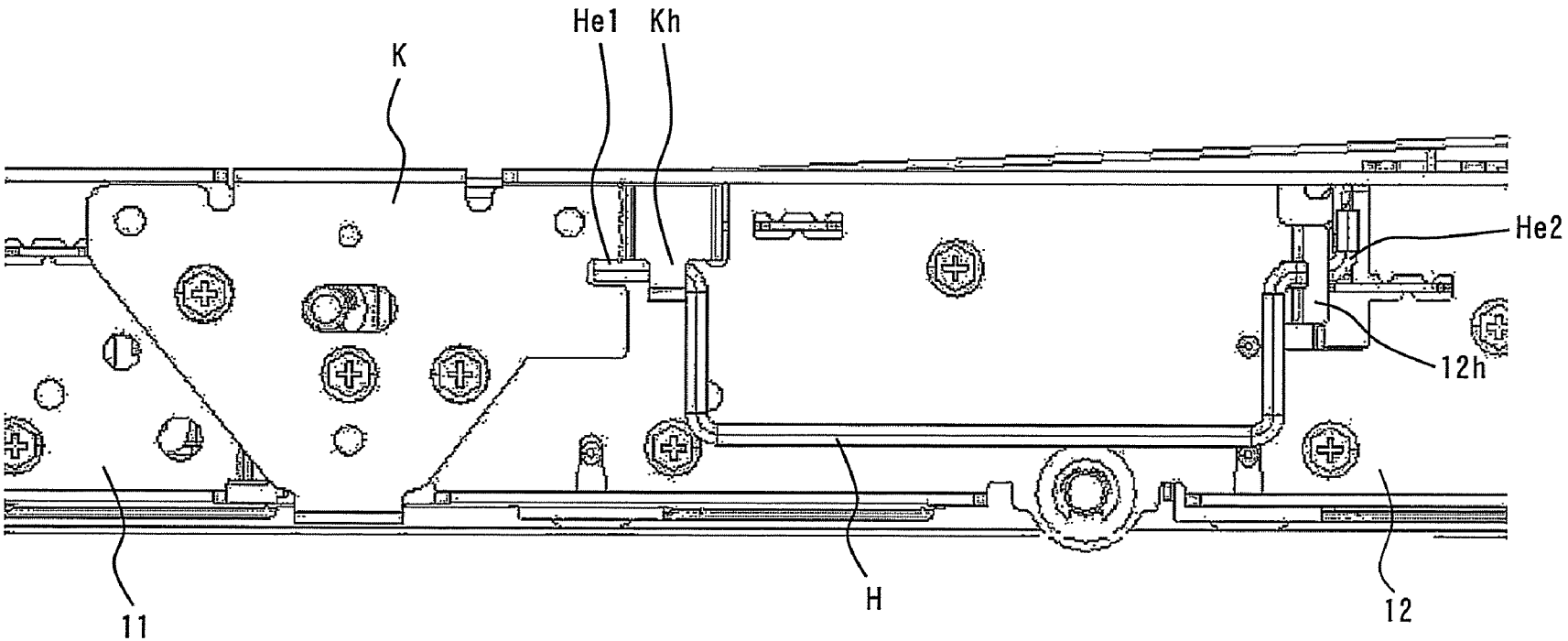
FIG. 9 is a partially enlarged view showing the vicinity of a connecting position between a forward unit 70 and rear unit 80 shown in FIG. 5 as viewed in a V direction.
Figure 10:
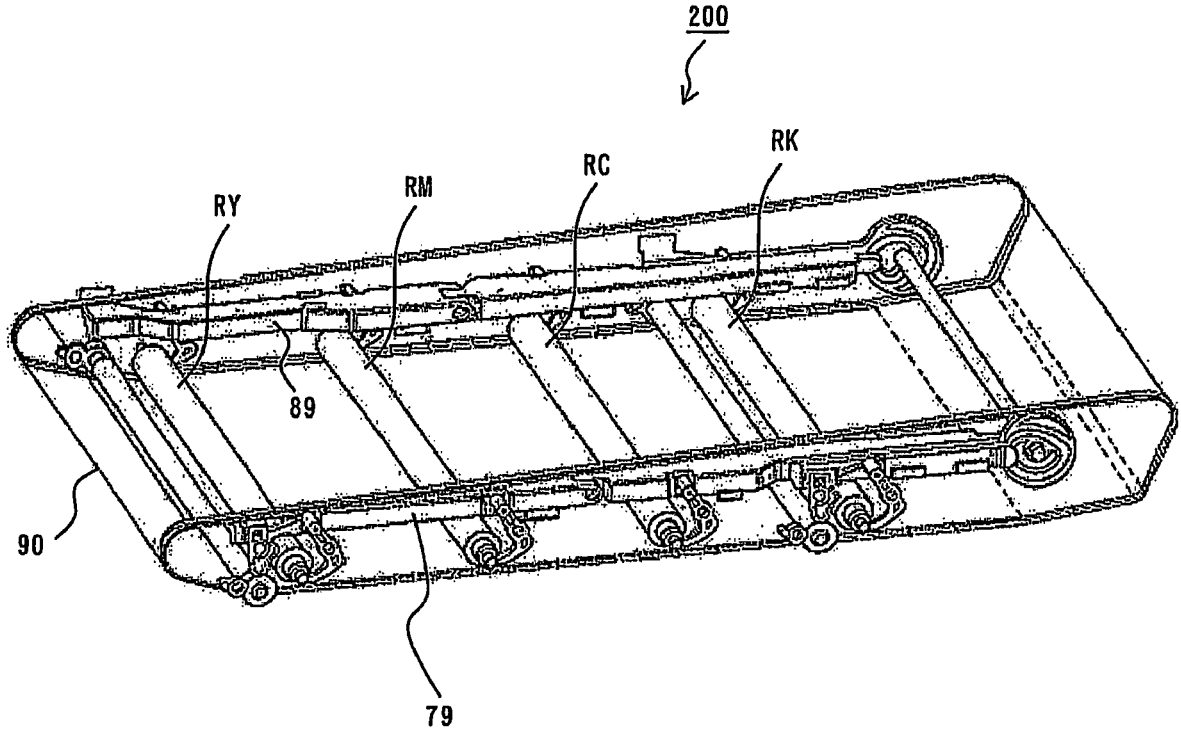
FIG. 10 is a view showing a conventional example of a transfer belt unit.

FIG. 9 is a partially enlarged view showing the vicinity of the connecting position between the forward unit 70 and rear unit 80 shown in FIG. 5 as viewed in a V direction. The transfer belt unit according to the present embodiment is mounted in an image forming apparatus by being inserted substantially horizontally into a predetermined insertion position provided on a side surface of the image forming apparatus with fixing a positional relationship between the front unit 70 and rear unit 80 by a fixing unit K (fixing means) composed of a metal fitting for fixation so that the angle between the front unit 70 and rear unit 80 around the rotational axis in the connecting unit may be equal to about 180 degrees (the front unit 70 and rear unit 80 may be aligned substantially on a straight line) (see FIGS. 1 and 5). In addition, the positional relationship between the front unit 70 and rear unit 80 fixed by the fixing unit K is equal also to a predetermined positional relationship in rotating the transfer belt (in using the transfer belt).

Here, the fixing unit K fixes the positional relationship between the front unit 70 and rear unit 80, for example, by screwing (fixing position) and can be removed from the front unit 70 and rear unit 80 by removing the screws. In this manner, by removing the fixing unit K from the front unit 70 and rear unit 80 (release position), the fixing of the positional relationship between the front unit 70 and rear unit 80 is released.

In addition, here, for an illustrative purpose, a configuration in which the fixing unit K can be completely removed from the front unit 70 and rear unit 80 is described. However, the configuration is not limited the above example, and there may be employed a configuration in which, for example, an end of the fixing unit K (for example, an end at which a supporting unit Kh described later in the fixing unit K is not provided) is rotatably connected to either the front unit 70 or rear unit 80 and is rotated to a position (fixing position) coming into contact with either the front unit 70 or rear unit 80 only when the positional relationship between the front unit 70 and rear unit 80 is fixed. As described above, there is employed a configuration in which the fixing unit K is connected to the frame members regardless as to whether the fixing unit K is in the fixing position or release position, thereby allowing the fall or loss of the fixing unit K to be avoided in maintaining the transfer belt unit. Moreover, the positioning in moving the fixing unit K from the release position to the fixing position is also facilitated.

Moreover, the transfer belt unit according to the present embodiment is provided with a handle unit H (holding means) for allowing the transfer belt unit to be transported by one hand when removed from the image forming apparatus. Here, the handle unit H is a bar-like member bent, for example, like a handle. The handle unit H is supported at one end He2 thereof on the side of the frame member (left rear side surface 12) configuring the rear unit 80 and is supported at the other end He1 thereof rotatably in a direction of an arrow shown in FIG. 5 by the supporting unit Kh in the fixing unit K only when the fixing unit K is in the fixing position.

In this manner, by employing a configuration in which the handle unit H can be supported at the other end He1 thereof only when the fixing unit K is in the fixing position, when the positional relationship between the front unit 70 and rear unit 80 is not fixed by the fixing unit K (the fixing unit K is in release position and the front unit 70 and rear unit 80 are relatively rotatable), the handle unit H is not supported at the other end He1 thereof and cannot function as a handle.

In other words, only when the positional relationship between the front unit 70 and rear unit 80 is fixed by the fixing unit K (the front unit 70 and rear unit 80 are not relatively rotatable with respect to each other), the handle unit H can be used.

In this manner, by employing a configuration in which the handle unit cannot be used when the fixing unit K is moved to release position, when trying to hold the transfer belt unit by using the handle unit H by accident in the case where the fixing unit K is in release position and the front unit 70 and rear unit 80 are relatively rotatable with respect to each other, there can be avoided a situation in which the bent transfer belt unit is suddenly extended by empty weight (situation resulting in damage or failure of the transfer belt unit).

Moreover, in the present embodiment, an engaging unit 12*h* (engaging means) that engages the one end He2 of the handle unit H is formed in the frame member (left rear side surface 12) supporting the one end He2 of the handle unit H. The handle unit H engages with the engaging unit 12*h* at the one end thereof. He2, thereby being supported so as not to drop out from the frame member. In this manner, the handle unit H is supported at the one end He2 thereof so as not to drop out (be disengaged) from the frame member, thereby allowing the fall or loss of the handle unit H to be prevented in maintaining the transfer belt unit.

Moreover, in the present embodiment, the handle unit H is supported at the both ends He1 and He2 thereof in the vicinity of the upper position of the transfer belt unit in inserting the transfer belt unit into the image forming apparatus (in the vicinity of the upper side end portion in FIG. 6). By employing such a configuration, when the transfer belt unit is inserted to a predetermined insertion position of the image forming apparatus (at the time of mounting), even if the handle unit H falls downward due to empty weight, the handle unit H does not protrude from the transfer belt unit. Moreover, there is also an advantage of facilitating the arrangement of a relatively large handle unit H. Moreover, if the handle unit H is not retracted specially by a user, the handle unit H can be retracted automatically into a position in which the insertion operation is not disturbed by mounting the transfer belt unit in the image forming apparatus.

Moreover, according to the present embodiment, there can be provided also an image forming apparatus comprising a transfer belt unit having an advantage as described above, photoconductors for transferring toner images on the belt surface of a transfer belt of the transfer belt unit, and transfer rollers for transferring the toner images transferred on the belt surface of the transferring belt on a sheet.

The present invention has been described in detail in accordance a specific embodiment, however, it is obvious to those skilled in the art that various changes and modifications may be made without departing from the spirit and scope of the present invention.

As described above in detail, there can be provided a technology capable of avoiding troubles caused by accidentally holding the handle for holding the transfer belt unit in maintaining the transfer belt unit.

What is claimed is:

1. A transfer belt unit, comprising:

a frame unit that is composed of a plurality of frame members and supports rollers around which a transfer belt is wound;

a connecting unit that connects the plurality of frame members of the frame unit to one another relatively rotatably on a plane including the rotational direction of the transfer belt;

a fixing unit that is movable between a fixing position where the plurality of frame members is fixed to one another so that a predetermined positional relationship may be established in rotating the transfer belt and release position where the fixing of the plurality of frame members to one another is released; and a handle unit that is supported at one end thereof on any one of the plurality of frame members and supported at the other end thereof by the fixing unit only when the fixing unit is located in the fixing position.

2. The transfer belt unit according to claim 1, further comprising:

an engaging unit that is provided in the frame member supporting one end of the handle unit out of the plurality of frame members and engages with the one end of the handle unit to support the handle unit so that the handle unit may not drop out from the frame member.

3. The transfer belt unit according to claim 1, wherein the transfer belt unit is mounted in an image forming apparatus by being inserted substantially horizontally into a predetermined insertion position provided on a side surface of the image forming apparatus, and the handle unit is supported at both ends thereof in the vicinity of the upper position of the transfer belt unit in inserting the transfer belt unit into the predetermined insertion position.

4. The transfer belt unit according to claim 1, wherein the transfer belt unit performs mode switching at least between full-color printing mode and black-and-white printing mode by a link mechanism, the transfer belt unit includes a link unit that is composed of a plurality of link members connected to one another by a shaft member and performs the mode switching by the plurality of cooperating link members, and the connecting unit connects the plurality of frame members to one another relatively rotatably with the shaft member connecting the plurality of link members to one another as a central axis on a plane including the rotational direction of the transfer belt.

5. The transfer belt unit according to claim 4, wherein the link unit is composed of two link members connected to each other by a shaft member at a substantially central position in the longitudinal direction of the transfer belt unit.

6. The transfer belt unit according to claim 4, wherein the connecting unit connects the plurality of frame members composing the frame unit to one another relatively rotatably by a predetermined angle.

7. The transfer belt unit according to claim 4, wherein in the connecting unit, there are formed long holes allowing for the movement of the shaft members accompanying the movement of the link unit in performing the mode switching in the transfer belt unit.

8. A transfer belt unit, comprising:

roller supporting means that is composed of a plurality of frame members and supports rollers around which a transferring belt is wound;

connecting means for connecting the plurality of frame members of the roller supporting means to one another relatively rotatably on a plane including the rotational direction of the transfer belt;

fixing means that is movable between a fixing position where the plurality of frame members is fixed to one another so that a predetermined positional relationship may be established in rotating the transfer belt and release position where the fixing of the plurality of frame members to one another is released; and holding means that is capable of being held by being supported at one end thereof on any one of the plurality of frame members and supported at the other end thereof by the fixing means only when the fixing means is located in the fixing position.

9. The transfer belt unit according to claim 8, further comprising:

an engaging unit that is provided in the frame member supporting one end of the holding means out of the plurality of frame members and engaging with the one end of the holding means to support the holding means so that the holding means may not drop out from the frame member.

10. The transfer belt unit according to claim 8, wherein the transfer belt unit is mounted in an image forming apparatus by being inserted substantially horizontally into a predetermined insertion position provided on a side surface of the image forming apparatus, and the holding means is supported at both ends thereof in the vicinity of the upper position of the transfer belt unit in inserting the transfer belt unit into the predetermined insertion position.

11. The transfer belt unit according to claim 8, wherein the transfer belt unit performs mode switching at least between full-color printing mode and black-and-white printing mode by a link mechanism, the transfer belt unit includes a mode switching means that is composed of a plurality of link members connected to one another by a shaft member and performs the mode switching by the plurality of cooperating link members, and the connecting means connects the plurality of frame members to one another relatively rotatably with the shaft member connecting the plurality of link members to one another as a central axis on a plane including the rotational direction of the transfer belt.

12. The transfer belt unit according to claim 11, wherein the mode switching means is composed of two link members connected to each other by a shaft member at a substantially central position in the longitudinal direction of the transfer belt unit.

13. The transfer belt unit according to claim 11, wherein the connecting means connects the plurality of frame members of the roller supporting means to one another relatively rotatably by a predetermined angle.

14. The transfer belt unit according to claim 11, wherein in the connecting means, there are formed long holes allowing for the movement of the shaft members accompanying the movement of the mode switching means in performing the mode switching in the transfer belt unit.

* * * * *